US008660463B2

(12) United States Patent
Takeshita

(10) Patent No.: US 8,660,463 B2
(45) Date of Patent: Feb. 25, 2014

(54) IMAGE FORMING APPARATUS HAVING STRUCTURE FOR SECURING REMOVABLE UNIT

(75) Inventor: Hajime Takeshita, Tokyo (JP)

(73) Assignee: Oki Data Corporation, Tokyo (JP)

( * ) Notice: Subject to any disclaimer, the term of this patent is extended or adjusted under 35 U.S.C. 154(b) by 692 days.

(21) Appl. No.: 12/911,935

(22) Filed: Oct. 26, 2010

(65) Prior Publication Data

US 2011/0097110 A1 Apr. 28, 2011

(30) Foreign Application Priority Data

Oct. 28, 2009 (JP) ..... 2009-247712

(51) Int. Cl.
*G03G 15/08* (2006.01)

(52) U.S. Cl.
USPC ..... 399/121; 399/303; 399/312

(58) Field of Classification Search
USPC ..... 399/110, 121, 124, 303, 312, 313
See application file for complete search history.

(56) References Cited

U.S. PATENT DOCUMENTS

| | | | | |
|---|---|---|---|---|
| 6,157,797 | A * | 12/2000 | Saito et al. | 399/110 |
| 6,941,093 | B2 * | 9/2005 | Park et al. | 399/121 |
| 2005/0169667 | A1 * | 8/2005 | Katoh | 399/121 |
| 2006/0062593 | A1 * | 3/2006 | Takahashi | 399/121 |
| 2007/0231003 | A1 * | 10/2007 | Shoji | 399/121 |
| 2010/0329747 | A1 * | 12/2010 | Kouda | |

FOREIGN PATENT DOCUMENTS

| | | | | |
|---|---|---|---|---|
| JP | 07175285 | A * | 7/1995 | G03G 15/00 |
| JP | 07215511 | A * | 8/1995 | G03G 15/00 |
| JP | 10026856 | A * | 1/1998 | G03G 15/00 |
| JP | A-2000-194203 | | 7/2000 | |
| JP | 2005037672 | A * | 2/2005 | G03G 15/00 |
| JP | 2006-349780 | A | 12/2006 | |
| JP | A-2009-075402 | | 4/2009 | |

* cited by examiner

*Primary Examiner* — David Gray
*Assistant Examiner* — Laura Roth
(74) *Attorney, Agent, or Firm* — Muncy, Geissler, Olds & Lowe, PLLC

(57) ABSTRACT

An image forming apparatus includes a main body that includes a first engagement part, a first unit configured to be removably installed in the main body, and a second unit configured to be removably installed in the main body. The first unit includes a frame, a pivot shaft formed on the frame, a grip part that is rotatable around the pivot shaft and that includes a second engagement part that is configured to engage with the first engagement part, a pivot shaft hole that is configured to receive the pivot shaft, and a user operable operation part. When the second unit is laid on the first unit, the second unit presses the operation part and causes the grip part to rotate in a first direction such that the second engagement part engages with the first engagement part.

7 Claims, 7 Drawing Sheets

IMAGE FORMING APPARATUS HAVING STRUCTURE FOR SECURING REMOVABLE UNIT

CROSS REFERENCE TO RELATED APPLICATION

The present application is related to, claims priority from and incorporates by reference Japanese patent application number 2009-247712, filed on Oct. 28, 2009.

TECHNICAL FIELD

The present invention relates to an image forming apparatus, such as a printer or photocopier in an electrophotography system, in which a transfer unit is detachably mounted.

BACKGROUND

Conventional image forming apparatuses provide a transferring unit and an inverse carrying path. The transferring unit, which includes a carrying belt and a transferring roller, is positioned under an image forming unit. The image forming unit for forming toner images is pivotally attached to an apparatus body. The inverse carrying path, which is for a sheet for two-sided printing, is mounted under the transferring unit. The transferring unit transfers a toner image, which is formed in the image forming unit, onto a sheet that is carried by the carrying belt on the inverse carrying path mounted between the image forming unit and the transferring unit. A fusing unit fuses the toner image on the sheet. Then, the sheet is ejected to the outside of the apparatus.

When a sheet carried on the sheet carrying path between the image forming unit and the transferring unit jams, the sheet causing the jam is removed, without detaching the image forming unit, by pivoting the image forming unit and keeping the space between the image forming unit and the transferring unit (for example, see Japanese Patent Laid-Open Publication No. 2006-349780, Paragraph 0016-0023, 0036-0045, FIGS. 1 and 12).

However, with the above-described conventional art, when the carrying belt of the transferring unit is replaced and when a jam occurs during two-sided printing by the sheet being carried on the inverse carrying path mounted under the transferring unit, in order to replace the carrying belt or to remove the jammed sheet, the transferring unit must be detached with tools. And then, after the replacement of the carrying belt and the removal of the jammed sheet, the transferring unit must be mounted to the printer again with the tools. This increases the workload of the operators.

The present invention is to solve the above-described problems, and provides a configuration in which the transferring unit mounted to the image forming apparatus can be easily attached and detached.

SUMMARY

For the above problems, an image forming apparatus of the present invention is with a unit that is detachably attached to an apparatus body. The unit includes a projection part that pivots around a pivot axis, the projection part includes an engaging part that engages with an engaged part; the apparatus body includes the engaged part that engages with the engaging part, and engagement of the engaging part and the engaged part is released in response to external force applied to the projection part.

As a result, according to the present invention, processes to attach and detach the transferring unit can be easily performed with less work on the part of the operator.

DETAILED DESCRIPTION

Hereafter, embodiments of an image forming apparatus of the present invention will be explained referring the drawings.

Figure 1:
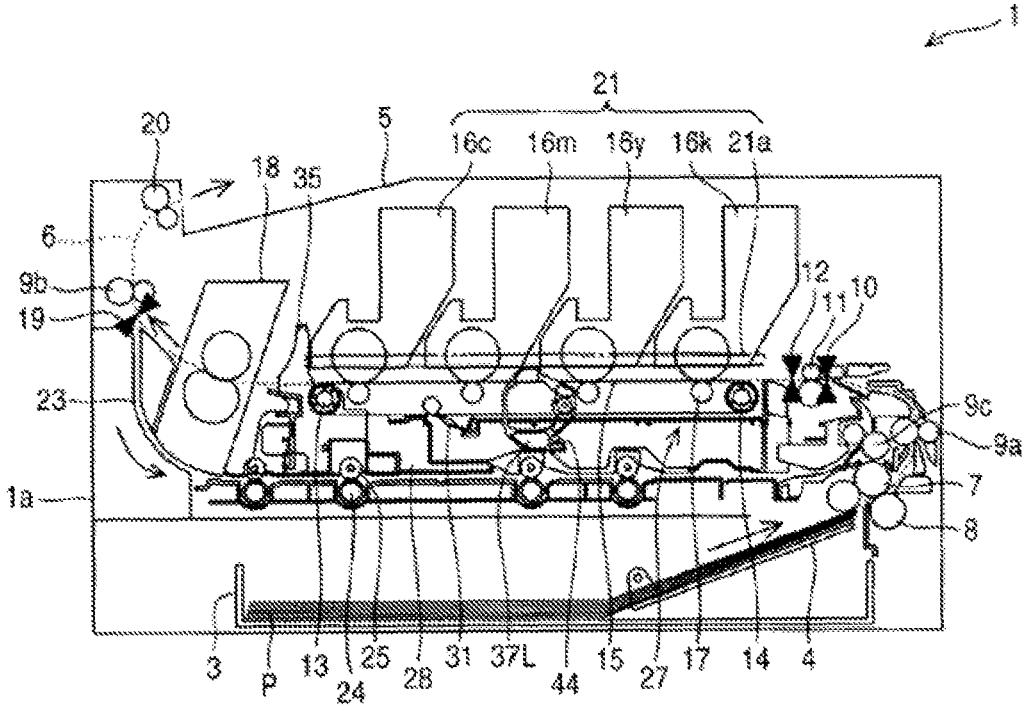
FIG. 1 is explanatory diagrammatic side view of an image forming apparatus of a first embodiment.
Figure 2:
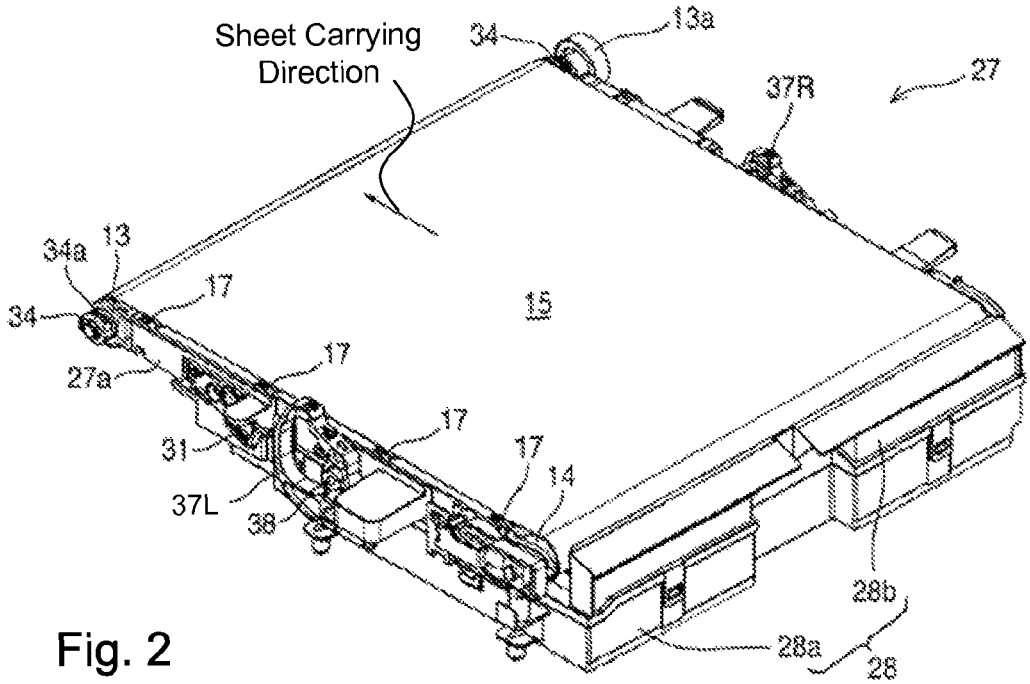
FIG. 2 is a perspective view of the transferring unit of the first embodiment, as seen from the top-left.
Figure 3:
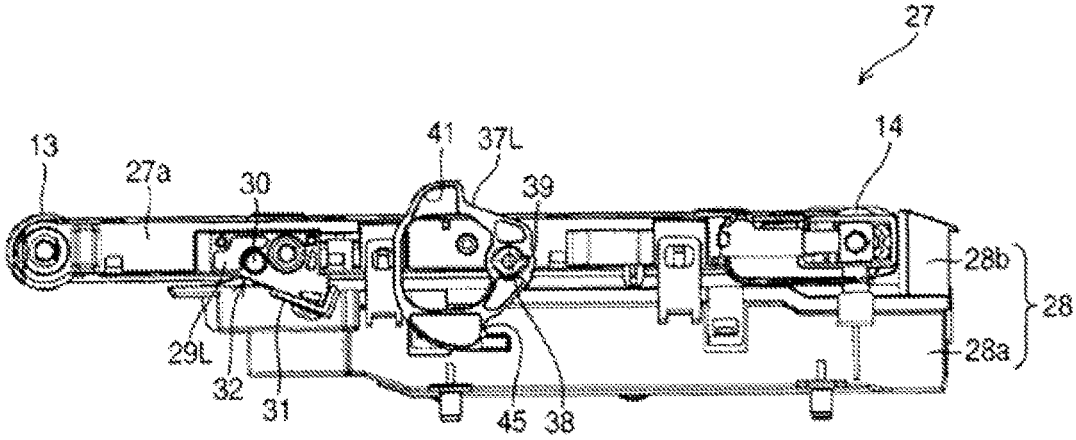
FIG. 3 is a left side view of the transferring unit of the first embodiment.

(First Embodiment) In FIG. 1, a printer 1 in an electrophotography system serves as an image forming apparatus.

A sheet feeding cassette 3 for containing a sheet P, which is a medium for print, is positioned under an apparatus body 1*a* of the printer 1. A sheet receiver 4 is mounted in the sheet feeding cassette 3. The sheet receiver 4 is pivoted by a lift-up mechanism (not shown) so that a leading-edge side of the sheet P is inclined and lifted up.

A stacker 5 where the printed sheet P stacks is mounted at an upper part of the printer 1. A sheet carrying path 6A illustrated with a broken line in FIG. 1 connects the sheet feeding cassette 3 and the stacker 5.

At a connecting part of the sheet carrying path 6 and the sheet feeding cassette 3, a hopping roller 7 and a retard roller 8 are mounted for feeding the sheets P seriatim from the sheet feeding cassette 3 to the sheet carrying path 6. Each sheet P fed by a hopping roller 7 is carried to a carrying belt 15, which is located between a drive roller 13 and a driven roller 14, via a pair of carrying rollers 9*a*, an in-sensor 10, a pair of registration rollers 11 and a right timing sensor 12. A toner image as a developer image is transferred on the sheet P by a plurality of developing units 16 and transferring rollers 17 as a transferring member. The developing units 16 and the transferring rollers 17 are positioned on both sides of one side of the carrying belt 15 in a facing manner. Regarding the sheet P on which the toner image is transferred, the toner image is fused on the sheet P in a fusing unit 18, and then the sheet P is carried to a pair of ejecting rollers 20 via an exit sensor 19 and a pair of carrying rollers 9*b* and is ejected onto the stacker 5.

In the above-described plurality of developing units 16, the developing units 16*k*, 16*y*, 16*m* and 16*c* are mounted along the carrying direction of the sheets P (hereafter referred to as a sheet carrying direction) in this order from the upstream direction. Each of the developing units 16*k*, 16*y*, 16*m* and 16*c* provides a detachable cartridge containing toner of a color K (black), color Y (yellow), color M (magenta) or color C (cyan), and serves as a developer. The four developing units 16 are detachably contained in a unit basket 21*a*, which is indicated by a dashed-two dotted line in FIG. 1. With this configuration, an image forming unit, which serves as a pushing unit, is configured.

An inverse carrying path 23 is a path. In the case of two-sided printing, the inverse carrying path 23 reverses the front and back sides of a sheet P on which a toner image is fused on the front side, so that the back side thereof faces in the direction of the image forming unit 21 with respect to the sheet carrying path 6. The inverse carrying path 23 is a forked path from the sheet carrying path 6 between the fusing unit 18 and the pair of carrying rollers 9*b*. The inverse carrying path 23 passes through a bottom side of a transferring unit 27, which will be described below in detail, and merges with the sheet carrying path 6 short of the in-sensor 10 via a pair of carrying rollers 9*c* at the merge point with the sheet carrying path 6. Mounted under the transferring unit 27 of the inverse carrying path 23 is a plurality of two-side carrying rollers 24 for carrying the sheet P to be reversed and pinch rollers 25 for pressing the two-side carrying rollers 24 with a spring (not shown).

As illustrated from FIGS. 2 through 5, in the transferring unit 27, the carrying belt 15 is positioned on the image forming unit 21 of a frame 27*a* such that the carrying belt 15 covers an upper surface of the transferring unit 27. A waste toner containment unit 28 is positioned in a lower part of the image forming unit 21, which is opposite to the carrying belt 15. A belt cleaning blade 31 is mounted on a blanket 29R and a blanket 29L, which are attached on left and right side surfaces of the frame 27*a*. The belt cleaning blade 31 is for removing a residual toner on a support roller 30 and the carrying belt 15 (see FIGS. 3 and 4). A transferring roller 17 is rotationally supported by the frame 27*a*. Similarly, a bottom surface of the transferring unit 27 functions as an upper carrying guide of the inverse carrying path 23.

In the present description, a left side with respect to a downstream side of a sheet carrying direction where the sheet P is carried by the carrying belt 15 of the transferring unit 27 is referred to as "left," a right side is referred to as "right".

At the inside of the carrying belt 15, the driven roller 14, four of the transferring rollers 17 and the drive roller 13 are positioned in this order from the upstream side of the sheet carrying direction of the sheet carrying path 6, and the transferring belt 15 is tensioned due to biasing force of a spring (not shown) mounted on the driven roller 14.

Figure 4:
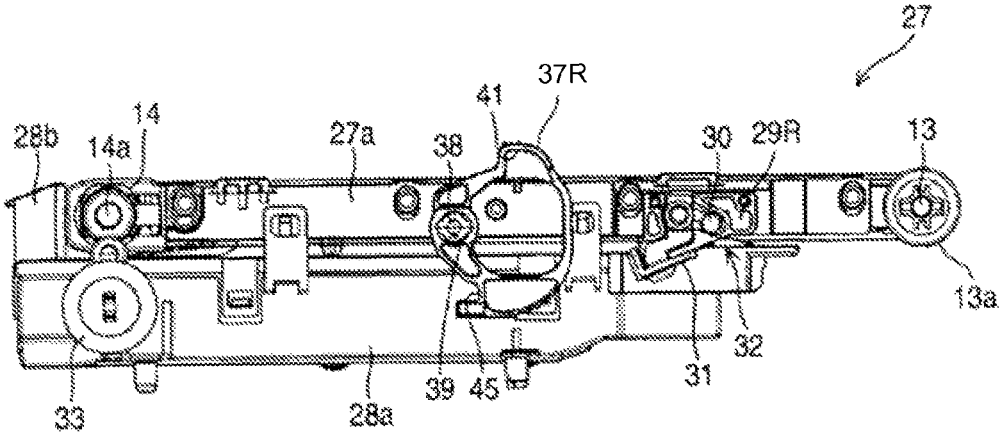
FIG. 4 is a right side view of the transferring unit of the first embodiment.
Figure 5:
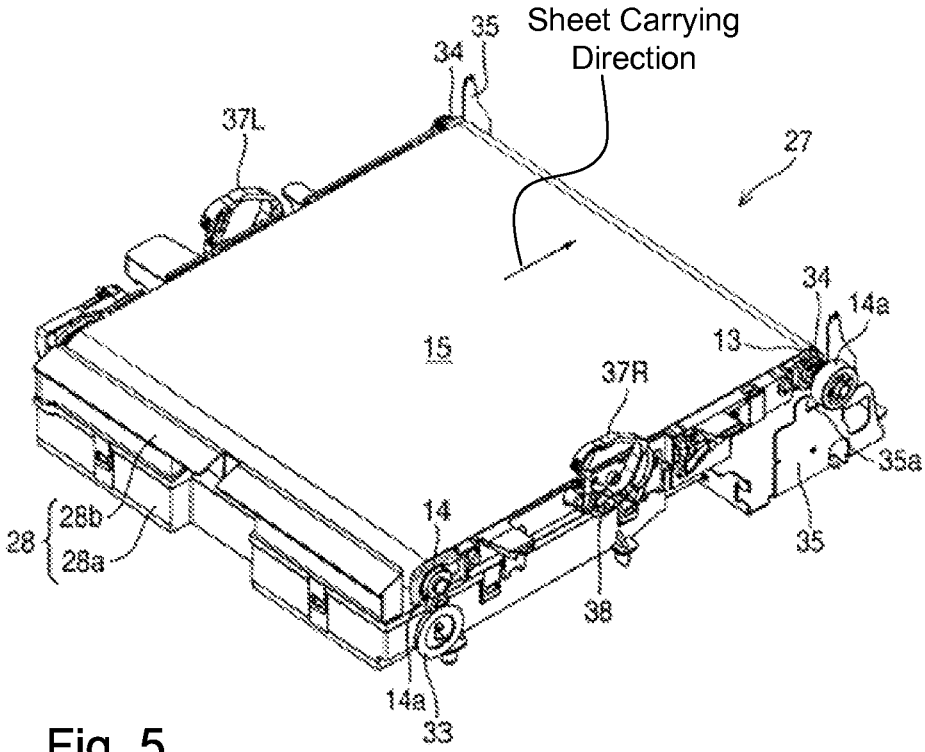
FIG. 5 is a perspective view of the transferring unit of the first embodiment, seen from the top-right.

A drive gear 13*a* is mounted to the drive roller 13, and a driven gear 14*a* is mounted to the driven roller 14 (see FIG. 4).

The waste toner containment unit 28 consists of a waste toner contain box 28*a* and a cover 28*b* thereof. A waste toner collecting port 32 is mounted at a sliding part of the carrying belt 15 and the belt cleaning blade 31 at the cover 28*b*.

In the waste toner containment unit 28, an agitating frame and an agitating shaft, which are not illustrated, are positioned to cross the inside of the waste toner contain box 28*a*. The agitating frame and the agitating shaft are driven by an agitating gear 33 (see FIG. 4) that works in response to the movement of the driven gear 14*a* and a gear row.

At both edge of a rotating shaft of a drive gear 13*a* of the transferring unit 27, a drive roller bearing 34 (see FIG. 2) is positioned. About the entire circumference of the drive roller bearing 34, a mating groove 34*a* is formed. In order to attach the transferring unit 27, a U-shaped receiver 35*a* (see FIG. 5) of an unit support bracket 35 mounted in the apparatus body 1*a* mates with the mating groove 34*a* so that the transferring unit 27 is positioned in a predefined position.

Lock levers 37 form handles, or projection parts, and are mounted on opposite side surfaces of the frame 27*a* in the sheet carrying direction of the sheet carrying path 6. One lock lever 37L is mounted on the left side surface, and the other lock lever 37R is mounted on the right side surface. Each of the lock levers 37 either clockwise or counterclockwise around the pivot shaft hole 39. Fitted in the pivot shaft hole 39 is a pivot shaft 38, which serves as a pivot fulcrum and is mounted on both of the left and right side surfaces of the frame 27*a* (when the distinction between left and right is unnecessary, the lock levers 37R, 37L are collectively referred to as lock levers 37).

Figure 6A:
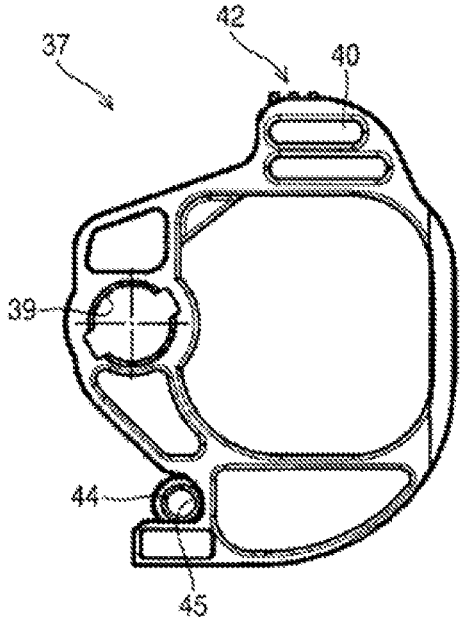
FIG. 6A is a side view of a lock lever of the first embodiment.
Figure 7:
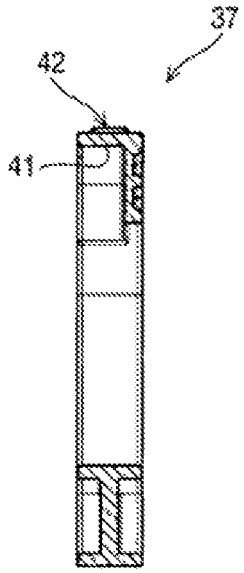
FIG. 7 is a cross-sectional view taken along line A-A of FIG. 5.
Figure 8:
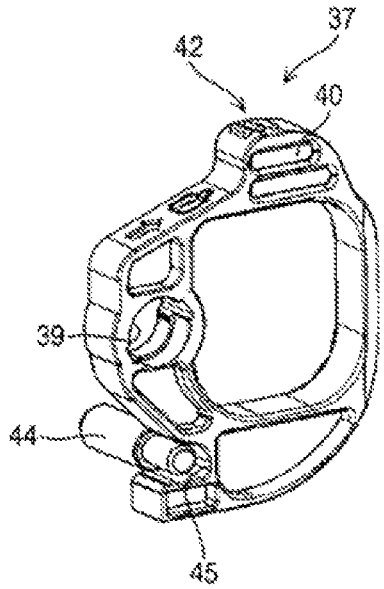
FIG. 8 is a perspective view of the lock lever of the first embodiment.

The lock lever 37L and the lock lever 37R are symmetrically arranged with respect to the center of the transferring unit 27. As illustrated in FIGS. 6-8, on the side facing the image forming unit 21 of each of the lock levers 37, an anti-slip form 40 and the operation part 42, which includes the finger insert part 41 on an underside thereof, are formed. On the opposite side with respect to the pivot shaft hole 39, the engaging part 45, which engages a post 44 mounted on both of the left and right side surfaces of the apparatus body 1*a*, is formed.

Figure 6B:
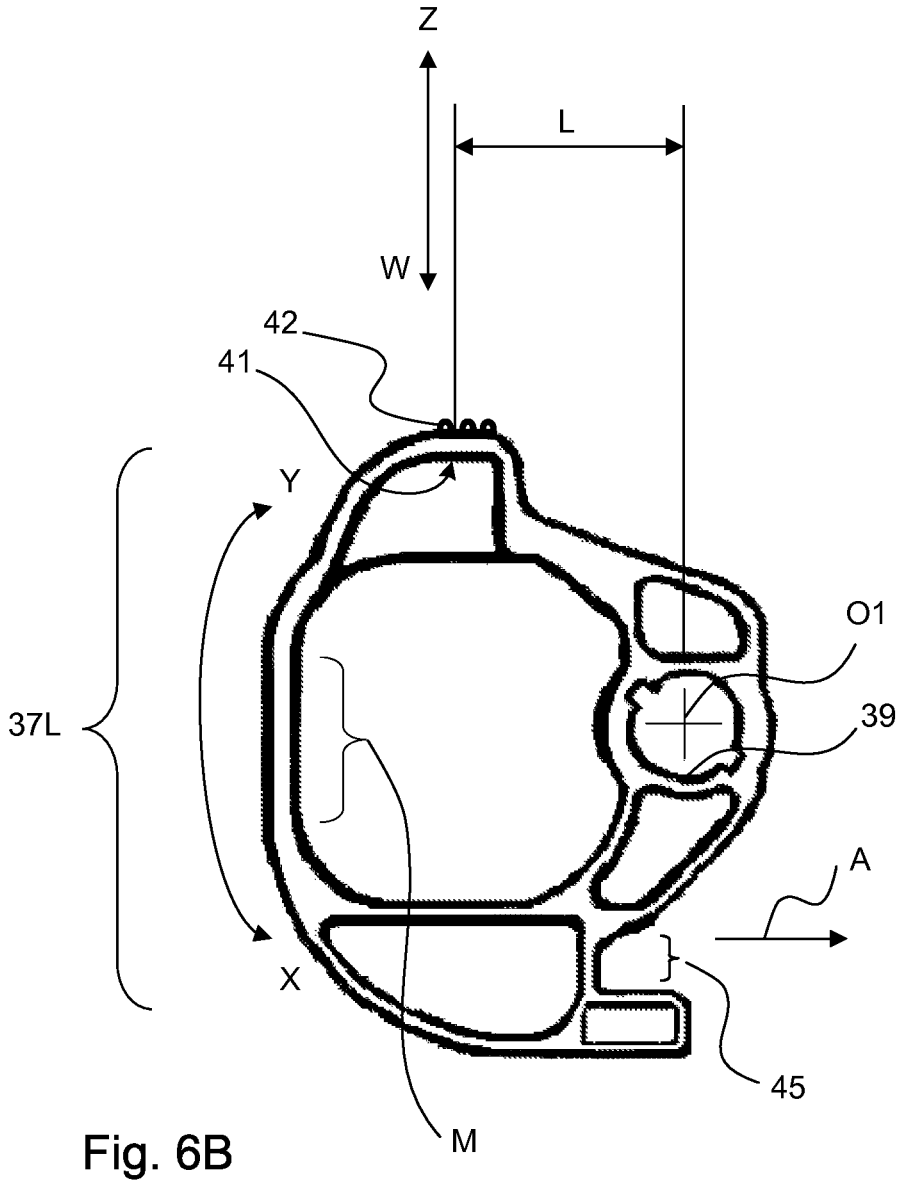
FIG. 6B is another side view of a lock lever.

As illustrated in FIG. 6B, a lock lever 37L, or projection part, includes a holding part M, a finger insert part 41, or a hook part, an operation part 42, an engaging part 45 and a pivot shaft hole 39, or a mating part, which has a pivot axis O1 for pivoting the lock levers 37 in the X-direction or Y-direction. Herein, the holding part M is formed as a penetrating hole so that it is easy to hold.

The finger insert part 41 and the operation part 42 are positioned with a distance L from the pivot axis O1. Accordingly, the lock lever 37L is forced to pivot in the Y-direction when an external force that urges the operation part 42 in the Z-direction with the finger insert part 41 is applied. The lock levers 37 are forced to pivot in the X-direction when an external force that urges the operation part 42 in the W-direction is applied.

The finger insert part 41 and the operation part 42 are upstream with respect to an opening direction A of the engaging part 45 at the pivot axis O1 of the lock levers 37. As a result, engagement of the engaging part 45 and the post 44 (see FIG. 1) is released when external force in the Z-direction (pulling force) is applied by the finger insert part 41. On the other hand, the engaging part 45 and the post 44 are engaged when external force in the W-direction (pushing force) is applied to the operation part 42.

The holding part M is positioned midway between the engaging part 45 and the finger insert part 41. Therefore, during a series of operations for detaching the transferring unit 27, when the lock lever 37L is pivoted by the operator's finger inserted in the finger insert part 41 to a sufficient degree to release the engagement of the engaging part 34 and the post 44, the holding part M permits the operator to easily hold the holding part M.

Furthermore, the operation part 42 is positioned above the surface of the carrying belt 15 on the side of the image forming unit 21. In other words, the operation part 42 is mounted to protrude toward the image forming unit 21 and is configured to contact a bottom surface of a unit basket 21 a while the image forming unit 21 is attached.

The handle parts of the present embodiment are formed with the lock lever 37L, the lock lever 37R, etc., where the engaging part 45 is formed.

The following is a description of printing processes of the printer 1 having the above-described configuration.

An operator inputs information regarding print material to the printer 1. A sheet P contained in the sheet feeding cassette 3 is lifted upward by the sheet receiver 4. Thereby, the sheet P contacts the hopping roller 7 and is fed to the sheet carrying path 6 by the hopping roller 7, which rotates in a feed direction. At this time, the retard roller 8 presses the hopping roller 7 with a predetermined force to prevent double feeding of sheets P.

The sheet P, which is fed by the hopping roller 7 and the retard roller 8, is held and carried by a pair of carrying rollers 9*a*. Then, the sheet P passes through the in-sensor 10 and abuts a pair of registration rollers 11 so that any skewing of the sheet P is corrected.

The sheet P, which is held by the pair of registration rollers 11 and passes through the right timing sensor 12, is carried to the image forming unit 21. When a predefined period passes after that the right timing sensor 12 detects a leading edge of the sheet P, toner images of each color, which are formed by the developing units 16*k*, 16*y*, 16*m* and 16*c*, are transferred to the sheet P by the transfer rollers 17 in sequence.

Then, the sheet P on which the toner images are transferred is carried to the fusing unit 18, and the toner images are fused on the sheet P at the fusing unit 18. Then, the sheet P passes through the exit sensor 19, is carried to the pair of ejecting rollers 20 by the pair of carrying rollers 9*b*, and is ejected to the stacker 5 by the pair of ejecting rollers 20.

For two-sided printing, when the exit sensor 19 detects a trailing edge of the sheet P on which the toner images are fused, the pair of carrying roller 9*b* and the pair of ejecting roller 20 stop and reverse. Thereby, the sheet P, the front side of which has been printed, is carried in a direction toward the inverse carrying path 23. The sheet P is guided to the inverse carrying path 23 and is held and carried through the inverse carrying path 23 by two-side carrying rollers 24 and pinch rollers 25. Then the sheet P is carried to the in-sensor 10 by the pair of carrying rollers 9*c*. As a result, the back side of the sheet P faces the image forming unit 21.

Since process for two-sided printing after passing through the in-sensor 10 is the same as the process for single-sided printing, a description thereof will be omitted.

When a jam occurs in the inverse carrying path 23 during the two-sided printing and/or the carrying belt 15 or another part of the transferring unit 27 is replaced, the transferring unit 27 is detached from the printer 1. An operator detaches the image forming unit 21 from the printer 1 and holds the operation parts 42 of the lock lever 37L and the lock lever 37R, which are positioned at both sides of the transferring unit 27. The operator pivots the lock lever 37L and the lock lever 37R toward the driven roller 14 of the transferring unit 27 (the clockwise direction in FIG. 3) around the pivot shaft 38, which is mounted on the frame 27*a*. As a result, the engaging parts 45 of the lock lever 37L and the lock lever 37R and the corresponding posts 44 of the apparatus body 1*a* are released from their engaged status. Then, the operator lifts the lock lever 37L and the lock lever 37R upward in an upward direction of FIG. 1 so that the transferring unit 27 is detached from the printer 1.

At this time, since the operation parts 42 of the lock levers 37 of the present embodiment provide the finger insert part 41 and the anti-slip form 40, the operator can appropriately operate the levers 37 without finger slippage.

After the removal of the sheet P causing the jam and/or the replacement of the carrying belt 15 or other part, the detached transferring unit 27 is attached to the printer 1. To replace the transferring unit, the operator holds the operation parts 42 of the lock lever 37L and the lock lever 37R positioned at both of the side surfaces of the transferring unit 27. Under this state, the operator mates the receiver 35*a* of the unit support bracket 35, which is mounted in the apparatus body 1*a* of the printer 1, with the mating groove 34*a* of the drive roller bearing 34 (see FIG. 5) from the above the printer 1. Then, the operator positions the transferring unit 27 in the predefined position, and pivots the lock lever 37L and the lock lever 37R toward the side of the drive roller 13 of the transferring unit 27 (the counter-clockwise direction in FIG. 3) around the pivot shaft 38. The operator engages the engaging parts 45 of the lock lever 37L and the lock lever 37R with the posts 44 of the apparatus body 1*a*. As a result, the transferring unit 27 is fixed to the printer 1.

At this time, since the operation parts 42 of the lock levers 37 of the present embodiment provide the finger insert part 41 and the anti-slip form 40, the operator can appropriately operate the levers 37 without finger slippage.

Figure 9A:
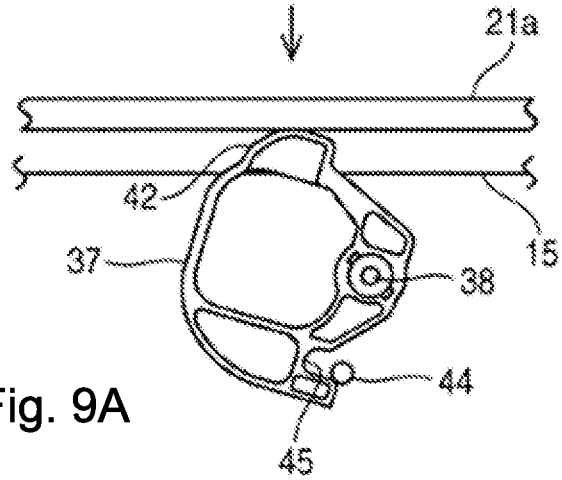
FIGS. 9A, 9B and 9C are diagrammatic side views illustrating an automatic engagement movement of the lock lever with the image forming unit.
Figure 9B:
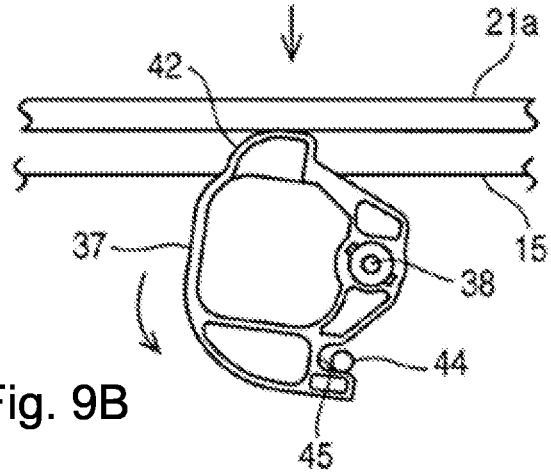
Figure 9C:
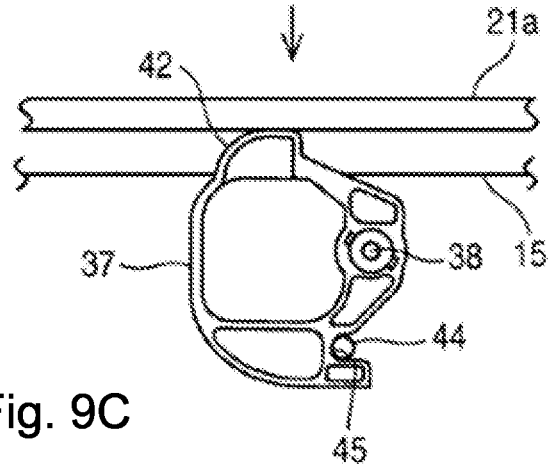

In the above-described attachment process, when the unit support bracket 35 is mated to the drive roller bearing 34 and the lock lever 37L and the lock lever 37R are pivoted around the pivot shaft 38, if the engaging parts 45 of the lock lever 37L and the lock lever 37R and the posts 44 are not engaged properly (see FIG. 9A), the transferring unit 27 moves upward due to the biasing force of the springs (not shown) mounted in the pinch rollers 25. However, the operation parts 42 of the lock lever 37L and the lock lever 37R of the present embodiment protrude above the surface of the side of the image forming unit 21 of the carrying belt 15. Accordingly, when the image forming unit 21 containing the developing units 16*k*, 16*y*, 16*m* and 16*c* is attached above the transferring unit 27, the bottom surface of the unit basket 21 a pushes the upper part of the operation parts 42 of the lock lever 37L and the lock lever 37R. Thereby, the lock lever 37L and the lock lever 37R are pushed downward in the vertical direction so that the lock lever 37L and the lock lever 37R are pivoted around the pivot shaft 38 (see FIG. 9B). Then, due to an automatic engagement process to engage the engaging part 45 with the post 44, the transferring unit 27 is automatically fixed to the printer 1 (FIG. 9C).

As explained above, in the present embodiment, the lock levers pivoting around the pivot shaft are mounted at both side surfaces of the transferring unit and the engaging part to engage the lock levers with the posts are located in the apparatus body. As a result, the detachment process and attachment process of the transferring unit are easily achieved only by rotating the lock levers in the predefined direction by both hands, so that the process is relatively easy for the operator.

Similarly, the operation parts of the lock levers protrude above the surface on the side of the image forming unit of the carrying belt, and the bottom surface of the unit basket is configured to push the operation parts at the time of attaching the image forming unit. Thus, even if the engaging parts of the lock levers and the posts are not properly engaged under an attached status of the transferring unit, once the image forming unit is attached, the bottom surface of the unit basket pivots the lock levers in an automatic engagement process, so that the transferring unit is automatically fixed to the printer. Although the present embodiment is described in connection with a transferring unit, the present embodiment is also applicable to the other detachable units with respect to the apparatus body.

Figure 10:
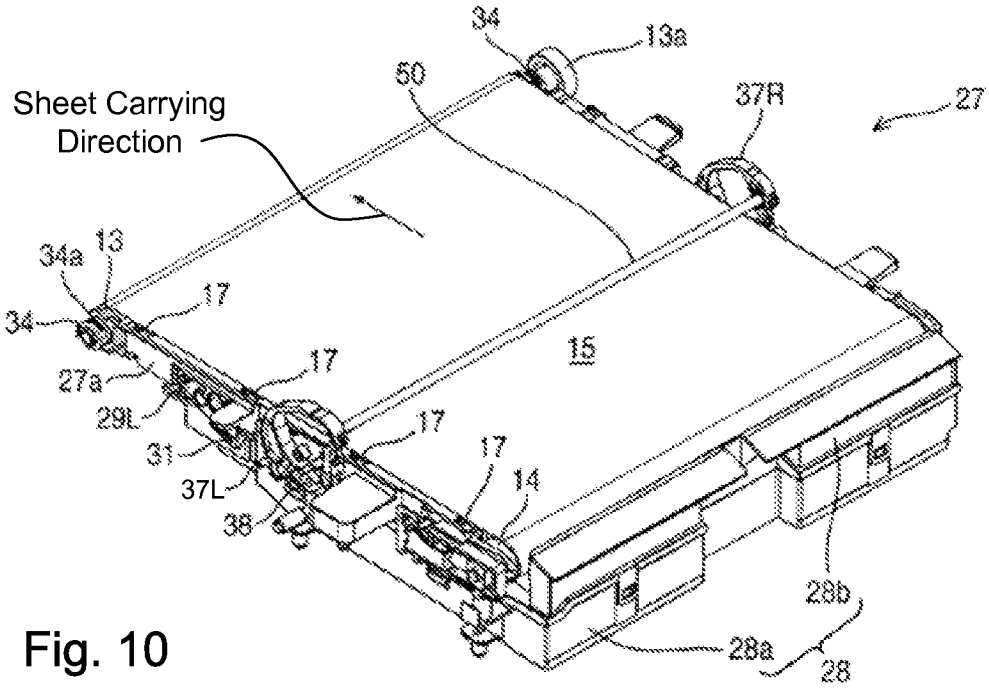
FIG. 10 is a perspective view of a transferring unit of a second embodiment, as seen from the top-left.
Figure 11:
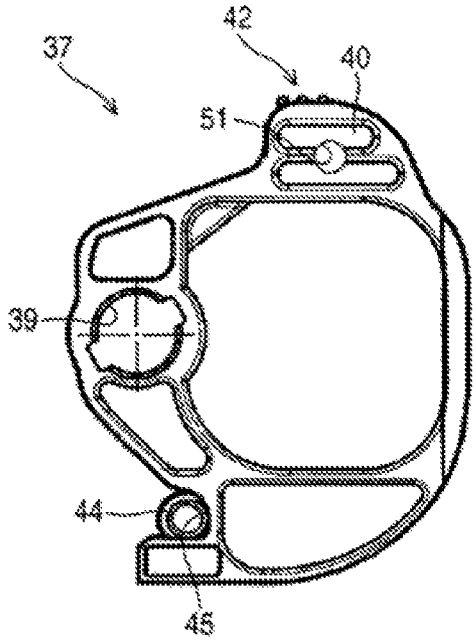
FIG. 11 is a side view of a lock lever of the second embodiment.

(Second Embodiment) Hereafter, a printer of the present embodiment will be described with reference to FIG. 10. Explanation of parts that are the same in the above-described first embodiment will be omitted. Parts that are the same in both embodiments have common reference characters In FIG. 10, a linkage rod 50 is a linkage member that links a lock lever 37L and a lock lever 37R, which are positioned on opposite sides of the transferring unit 27 and above a surface of the carrying belt 15 that faces the image forming unit 21. The linkage rod 50 is fitted in an attaching hole 51, which is a penetrating hole formed on the operation part 42 of the lock lever 37, as illustrated in FIG. 11. Also, the linkage rod 50 is configured to pivot the lock lever 37L and the lock lever 37R by the same angle toward a driven roller 14 of the transferring unit 27 (a clockwise direction in FIG. 3) when the linkage rod 50 is pulled upward.

Handle parts of the present embodiment include of the lock lever 37L and the lock lever 37R on which the engaging part 45 is located, and the linkage rod 50.

The printing process of the second embodiment is the same as that of the above-described first embodiment. Therefore, a description thereof is omitted.

When a jam occurs on an inverse carrying path 23 during two-sided printing, the transferring unit 27 is detached from the printer 1. The operator detaches the image forming unit 21 from the printer 1 and holds and pulls upward the linkage rod 50 that links the operation parts 42 of the lock lever 37L and the lock lever 37R, which are positioned on both sides of the transferring unit 27 of the printer 1. The operator pivots simultaneously the lock lever 37L and the lock lever 37R around a pivot shaft 38 toward the driven roller 14 of the transferring unit 27. As a result, the engaging part 45 of the lock lever 37L and the lock lever 37R and the post 44 are released from the engaging status, and the linkage rod 50 is pulled upward in a vertical direction to detach the transferring unit 27 from the printer 1.

The process of attaching the transferring unit 27 and an automatic engagement process between the post 44 and the engaging part 45 of the lock lever 37 of the image forming unit 21, during which the transferring unit 27 floats, is the same as described in connection with the first embodiment.

As explained above, in the second embodiment, the lock levers pivoting around the pivot shaft are attached on both side surfaces of the transferring unit, and the linkage rod, which mates with the attaching hole on the operation part of the lock lever, links both left and right sides of the lock lever above the carrying belt. As a result, the attachment and detachment processes of the transferring unit are easily performed, and the detachment process requires only pulling the linkage rod up with a single hand, so that the process is very simple.

Additionally, in each of the above-described embodiments, it is explained that the image forming apparatus is a printer in an electrophotography system. However, the image forming apparatus is not so limited, and another apparatus such as a scanner, an inkjet printer, copier etc is also applicable.

What is claimed is:

1. An image forming apparatus, comprising:

a main body that includes a first engagement part;

a first unit configured to be removably installed in the device main body, the first unit including:

a frame;

a pivot shaft formed on the frame;

a grip part that is rotatable around the pivot shaft, the grip part including a second engagement part that is configured to engage with the first engagement part, a pivot shaft hole that is configured to receive the pivot shaft, and a user operable operation part; and a second unit configured to be removably installed in the main body, wherein when the second unit is laid on the first unit, the second unit presses the operation part and causes the grip part to rotate in a first direction such that the second engagement part engages with the first engagement part, the first unit is a transfer unit that is configured to transfer a developer image onto a medium, and the second unit is an image forming unit that is configured to form the developer image.

2. The image forming apparatus according to claim 1, wherein when the operation part is pulled up by a user, the grip part rotates in a second direction opposite from the first direction so as to disengage the engagement of the first engagement part and the second engagement part.

3. The image forming apparatus according to claim 1, wherein the grip part is a first grip part, the first unit further includes a second grip part having the same shape as the first grip part, the frame includes first and second sides, the second side being on the opposite side of the frame from the first side, the first grip part is provided on the first side, and the second grip part is provided on the second side.

4. The image forming apparatus according to claim 3, wherein the first grip part and the second grip part are symmetrically arranged with respect to a center of the first unit.

5. The image forming apparatus according to claim 3, wherein the first unit further includes a linkage member that links the first grip part and the second grip part, and when the linkage member is operated by a user, the first grip part and the second grip part rotate together.

6. An image forming apparatus, comprising:

a main body that includes a first engagement part;

a first unit configured to be removably installed in the device main body, the first unit including:

a frame;

a pivot shaft formed on the frame;

a grip part that is rotatable around the pivot shaft, the grip part including a second engagement part that is configured to engage with the first engagement part, a pivot shaft hole that is configured to receive the pivot shaft, and a user operable operation part; and a second unit configured to be removably installed in the main body, wherein when the second unit is laid on the first unit, the second unit presses the operation part and causes the grip part to rotate in a first direction such that the second engagement part engages with the first engagement part, the grip part is a first grip part, the first unit further includes a second grip part having the same shape as the first grip part, the frame includes first and second sides, the second side being on the opposite side of the frame from the first side, the first grip part is provided on the first side, the second grip part is provided on the second side, the first unit further includes a linkage member that links the first grip part and the second grip part, and when the linkage member is operated by a user, the first grip part and the second grip part rotate together.

7. The image forming apparatus according to claim 6, wherein the first grip part and the second grip part are symmetrically arranged with respect to a center of the first unit.

* * * * *